US010873818B2

(12) United States Patent
Flaig et al.

(10) Patent No.: US 10,873,818 B2
(45) Date of Patent: Dec. 22, 2020

(54) DAMPING DEVICE FOR A RECEIVER OF A HEARING INSTRUMENT AND HEARING INSTRUMENT HAVING SUCH A DAMPING DEVICE

(71) Applicant: SIVANTOS PTE. LTD., Singapore (SG)

(72) Inventors: Uwe Flaig, Feucht (DE); Hartmut Ritter, Neunkirchen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 16/537,681

(22) Filed: Aug. 12, 2019

(65) Prior Publication Data

US 2020/0068321 A1 Feb. 27, 2020

(30) Foreign Application Priority Data

Aug. 24, 2018 (DE) ..... 10 2018 214 322

(51) Int. Cl.
*H04R 25/00* (2006.01)

(52) U.S. Cl.
CPC ..... *H04R 25/604* (2013.01); *H04R 25/60* (2013.01); *H04R 25/65* (2013.01); *H04R 25/70* (2013.01); *H04R 25/456* (2013.01); *H04R 2225/025* (2013.01)

(58) Field of Classification Search
CPC .... H04R 25/456; H04R 25/60; H04R 25/604; H04R 25/65; H04R 25/652; H04R 25/658; H04R 2225/025; H04R 2460/11
USPC ..... 381/322, 324, 328, 330, 354, 368; 181/130, 135
See application file for complete search history.

(56) References Cited

U.S. PATENT DOCUMENTS

| | | | | |
|---|---|---|---|---|
| 4,854,415 A * | 8/1989 | Goschke | H04R 25/60 | 181/130 |
| 6,751,326 B2 * | 6/2004 | Nepomuceno | H04R 25/604 | 381/322 |
| 7,088,839 B2 * | 8/2006 | Geschiere | H04R 25/604 | 381/324 |
| 2002/0061113 A1 * | 5/2002 | van Halteren | H04R 25/65 | 381/322 |
| 2008/0112584 A1 | 5/2008 | Karamuk | | |

FOREIGN PATENT DOCUMENTS

| | | |
|---|---|---|
| DE | 102010009782 A1 | 9/2011 |
| WO | 2007038897 A2 | 4/2007 |
| WO | 2014090282 A1 | 6/2014 |

* cited by examiner

*Primary Examiner* — Huyen D Le
(74) *Attorney, Agent, or Firm* — Laurence A. Greenberg; Werner H. Stemer; Ralph E. Locher

(57) ABSTRACT

A damping device for the anti-vibration mounting of a receiver within a hearing instrument includes an elastic damping element, a cage connected to the elastic damping element, and a shell surrounding the cage. The elastic damping element and at least a part of the shell have a lower hardness than the cage. A hearing instrument having a corresponding damping device is also provided.

10 Claims, 4 Drawing Sheets

DAMPING DEVICE FOR A RECEIVER OF A HEARING INSTRUMENT AND HEARING INSTRUMENT HAVING SUCH A DAMPING DEVICE

CROSS-REFERENCE TO RELATED APPLICATION

This application claims the priority, under 35 U.S.C. § 119, of German Patent Application DE 10 2018 214 322.6, filed Aug. 24, 2018; the prior application is herewith incorporated by reference in its entirety.

BACKGROUND OF THE INVENTION

Field of the Invention

The invention relates to a damping device for the anti-vibration (vibration-damping) mounting of a receiver within a hearing instrument. The invention further relates to a hearing instrument having a corresponding damping device.

The term "hearing instrument" generally refers to devices that receive an ambient sound, modify it by signal-processing techniques and output a modified acoustic signal to the auditory system of a person (a "wearer") wearing the hearing aid.

A hearing instrument which is constructed to treat a hearing-impaired wearer and which processes, in particular amplifies, the ambient acoustic signals in such a way that a hearing loss is wholly or partially compensated, is referred to herein and in the following as a "hearing aid." To this end, a hearing aid usually includes an input transducer, for example in the form of a microphone, a signal processing unit with an amplifier, and an output transducer. The output transducer is typically implemented as a miniature loudspeaker and is also referred to as a "receiver."

In addition to hearing aids, however, there are also hearing instruments aimed at assisting people with normal hearing, to protect the auditory canal of the wearer or to provide support in the perception of sound in noise (e.g. speech comprehension in complex noise environments) for specific purposes. Such hearing instruments are often constructed in a similar way to hearing aids and also include, in particular, the above components of input transducer, signal processing and output transducer.

Different configurations of hearing instruments are available in order to satisfy the wide range of individual requirements. In the case of so-called BTE (Behind-the-Ear) hearing instruments, a housing fitted with the input transducer, the signal processing and a battery is worn behind the ear. Depending on the configuration, the receiver can be positioned either directly in the auditory canal of the wearer (so-called ex-receiver hearing instruments or receiver-in-the-canal, abbreviated as RIC hearing instruments). Alternatively, the receiver is disposed inside the housing itself. In such cases, a flexible sound tube, also known simply as a tube, directs the acoustic output signals of the receiver from the housing to the auditory canal (tube-based hearing instruments). In the case of so-called ITE (In-the-Ear) hearing instruments, a housing which contains all of the functional components including the microphone and the receiver is worn at least partially inside the auditory canal. So-called CIC (completely-in-canal) hearing instruments are similar to the ITE hearing instruments, except that they are worn completely inside the auditory canal.

Regardless of the configuration, a secure and, in particular, vibration-damped mounting of the receiver within the housing of the hearing instrument is necessary to minimize the transmission of airborne and structure-borne sound within the housing and thus to prevent the occurrence of acoustic feedback as much as possible.

In order to achieve an effective vibration damping, the receiver of a hearing instrument is usually mounted with individually shaped (for each hearing instrument model) supports, which are adapted both to the respective receiver configuration as well as the available space in the hearing instrument and to the required amplification of the hearing instrument. Currently, the attenuation of a receiver is carried out by using a rubber band or a rubber boot wrapped around the rear portion of the receiver, thus preventing the receiver from impinging against the hard housing wall of the hearing instrument. In addition, receivers are often enclosed in chambers made of metal or plastic, to avoid transmission of airborne noise within the housing of the hearing instrument as far as possible.

Effective damping configurations are becoming increasingly important, particularly in view of the growing standardization of production processes. In particular, hearing instruments nowadays are often developed as part of a device family, which includes the various configurations (e.g. BTE, ITE or RIC devices) with standard components. Conversely, device families are also developed which have a standard housing containing different components, in particular receivers with different configurations (e.g. simple and dual receivers) and/or different power levels. In both cases, in particular in the case of a BTE device with a relatively large housing, the vibration damping of the receiver is challenging, since in that case receivers with a shape poorly matched to the installation spaces (but sometimes relatively high weight and/or high power) must frequently be attached in a stable manner, but with good vibration damping. The various functions of the receiver mounting, namely the mechanical holding function and the vibration damping function, are often in conflict because they would require mutually contradictory configurations of the receiver mounting and are therefore difficult to reconcile with each other. Thus, in particular from the point of view of an effective vibration damping, a comparatively soft configuration of the receiver mounting would be advantageous, but that would be disadvantageous in terms of a low-vibration mechanical mounting of the receiver.

SUMMARY OF THE INVENTION

It is accordingly an object of the invention to provide a damping device for a receiver of a hearing instrument and a hearing instrument having such a damping device, which overcome the hereinafore-mentioned disadvantages of the heretofore-known devices and instruments of this general type and which enable a secure mounting of a receiver within a hearing instrument which is effective in terms of vibration damping.

With the foregoing and other objects in view there is provided, in accordance with the invention, a damping device for anti-vibration mounting of a receiver within a hearing instrument, the damping device comprising an elastic damping element, a cage connected to the elastic damping element, and a shell surrounding the cage, in which both the elastic damping element as well as at least a portion of the shell have a lower hardness than the cage.

It has been shown that the combination, as viewed from the inside outwards, of soft material of the damping element, hard material of the cage and, in turn, soft material of the shell, is particularly advantageous to the vibration-damped mounting of receivers (particularly heavy and/or powerful receivers). In particular, the material of the inner damping element can be configured to be particularly soft, as a result of the supporting effect of the hard cage. Thus, a particularly effective vibration damping, in particular at high frequencies, is achieved without the need to allow for any weakening of the mechanical mounting of the receiver. The soft shell is in turn particularly effective for the attenuation of low frequencies. In particular, it prevents vibrations of the receiver from causing the cage to oscillate due to mechanical feedback effects. In addition, the shell efficiently protects the receiver from damage due to mechanical shocks, for example, if the hearing instrument is dropped.

The elastic damping element is preferably completely or partly manufactured from an elastomer material, and particularly preferably from a fluoroelastomer and/or a fluorosilicone elastomer. The hardness class of this elastic material preferably has a Shore hardness (Shore A) in a range between 20 and 30, and particularly preferably a Shore hardness of 25.

The shell or its soft part are also preferably manufactured from a fluoroelastomer and/or a fluorosilicone elastomer. The hardness class of this elastic material of the shell preferably has a Shore hardness in a range between 50 and 60. The use of the fluoroelastomer "Viton" from the DuPont company is particularly suitable in this case.

The cage, which has a greater hardness compared to both the damping element as well as to (the whole or part of) the shell, is preferably made of a (dimensionally stable) plastic, in particular from (reinforced or non-reinforced) polyamide or polycarbonate. A "dimensionally stable plastic" refers to a thermosetting plastic or a (non-elastomer) thermoplastic. Alternatively, in the context of the invention the cage can also be formed of a metal, for example, a steel plate.

In a preferred embodiment the shell (also referred to as a box) is implemented in two parts. In particular, it is formed of two half-shells which are pushed from opposite sides onto the assembly formed from the damping element and the cage. In the context of the invention the two parts of the shell can be formed of the same material or of different materials (in particular with different hardness). A particularly advantageous embodiment of the invention in this case is one in which a frontal region of the shell is made from a relatively hard material, in particular a dimensionally stable plastic, or from metal, and a rear region is made from a relatively soft material, in particular the above-mentioned elastomer material. The front section refers to that region of the shell which the sound outlet of the receiver is facing towards in the assembled condition, and on which the sound tube is introduced into the shell in a BTE device.

In order to prevent the propagation of the airborne sound emitted by the receiver (outside of the sound outlet) in the housing of the hearing instrument as far as possible, the shell is preferably configured in such a way that it encloses a mounting space for the receiver—and thus also the damping element reinforced by the cage—in an airtight manner. In other words, the shell is configured to be completely closed, in order to create a closed air volume in which the receiver is properly mounted. The volume of air closed off by the shell is advantageously used as an extension of the rear volume for the receiver.

Such an extended rear volume is required in particular in receivers with higher power and/or small receiver housings. In such a receiver the fact that the vibration of the sound-producing diaphragm also compresses air behind the diaphragm is particularly noticeable. With a closed receiver housing, the diaphragm vibration in the air space behind the diaphragm (rear volume) would cause perceptible pressure fluctuations with short-term positive and negative pressures, which would counteract the deflection of the diaphragm and reduce the efficiency of the receiver (and thus also, in particular, the resulting sound power). In order to increase the efficiency of the receiver, powerful or particularly small receivers therefore often have a pressure equalizing opening (back venting) behind the diaphragm, so that the air space surrounding the receiver enlarges the rear volume of the receiver. A receiver with back venting emits more airborne sound to the rear, however, so that it is expedient to hermetically seal the air space around the receiver to prevent crosstalk of the sound from the receiver to the or each microphone of the hearing instrument (with the consequent risk of feedback). This is achieved in a particularly effective way by the airtight configuration of the shell described above.

The elastic damping element is preferably configured as a tube which fully encloses the receiver. In other words, the damping element is placed externally on the receiver around its outer circumference. The front and the rear side of the receiver preferably remain open.

The elastic damping element advantageously includes retaining tabs, which in the assembled condition rest against the receiver and hence clamp the receiver between themselves. In the context of the invention the retaining tabs can be adapted in terms of their size and damping properties to the size and weight of the individual receiver to be mounted. In an advantageous configuration the retaining tabs are implemented as conical studs, having distal ends which form a contact surface for the receiver to be mounted.

In an advantageous configuration of the invention the cage is configured in such a way that it surrounds the damping element, so that the outer periphery or circumference of the damping element is in contact with an inner periphery or circumference of the cage. In another preferred alternative configuration, the cage is at least partially embedded in the material of the damping element. This achieves a form-locking connection between the material of the damping element and the material of the cage, allowing the soft material of the damping element to be reinforced in a particularly effective way. In a further alternative configuration, the damping element is formed of a plurality of non-contiguous retaining tabs which are individually connected to the cage, in particular injection molded to the cage.

With the objects of the invention in view, there is also provided a hearing instrument comprising a housing, a receiver and a damping device in accordance with one of the embodiments of the invention described above. The receiver is mounted by the damping device in a vibration-damped manner within the housing of the hearing instrument.

The advantages and preferred embodiments described for the damping device according to the invention are equally applicable to the hearing instrument according to the invention and can be logically transferred thereto.

The shell, i.e. the casing enclosing the damping element and the cage, is in particular fitted to the internal shape of a housing recess of the hearing instrument provided for supporting the receiver, and rests at least partially in contact with a wall of the housing so that the receiver is held through the damping device in a designated, stable position and without play. Despite the play-free mounting, the damping device allows sufficient mobility of the receiver to be able to absorb (i.e. dissipate) vibrational energy, especially in the higher frequencies. The surface of the shell is optionally structured, in particular notched, in order to reduce as effectively as possible a force transmission due to a movement of the receiver towards the housing that surrounds the shell in the assembled condition of the hearing instrument. As a result of the structuring of the surface of the shell, the shell is not in contact with the surrounding wall of the hearing instrument over its whole surface area, but only in discrete regions. This allows the areas of the shell that are not in contact with the housing wall to deform in response to movements of the receiver, in particular to bulge out, without touching the housing wall, so that a comparatively high proportion of the receiver movements can be absorbed by the shell.

The damping device according to the invention is preferably used in a BTE hearing aid. However, in the context of the invention, it can also be used to advantage in an ITE hearing instrument, provided there is enough space available.

Other features which are considered as characteristic for the invention are set forth in the appended claims.

Although the invention is illustrated and described herein as embodied in a damping device for a receiver of a hearing instrument and a hearing instrument having such a damping device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
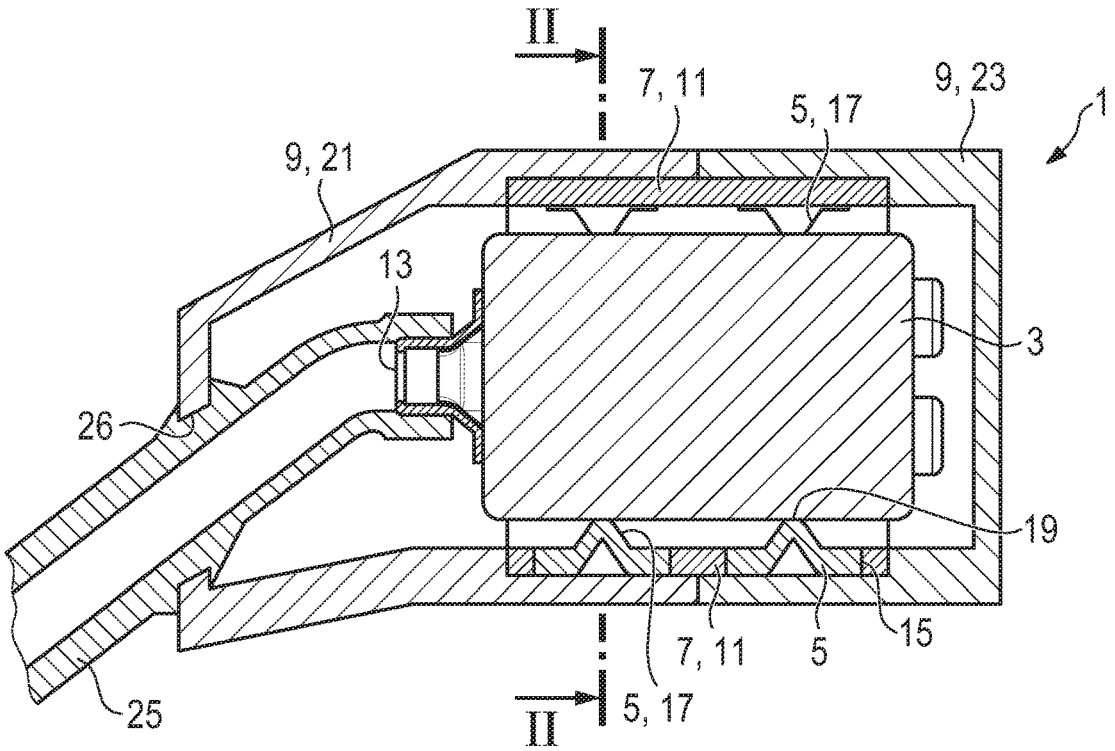
FIG. 1 is a fragmentary, diagrammatic, longitudinal-sectional view of a damping device with an elastic damping element, a cage supporting the element and a shell enclosing the cage as well as a receiver mounted in the damping device.
Figure 2:
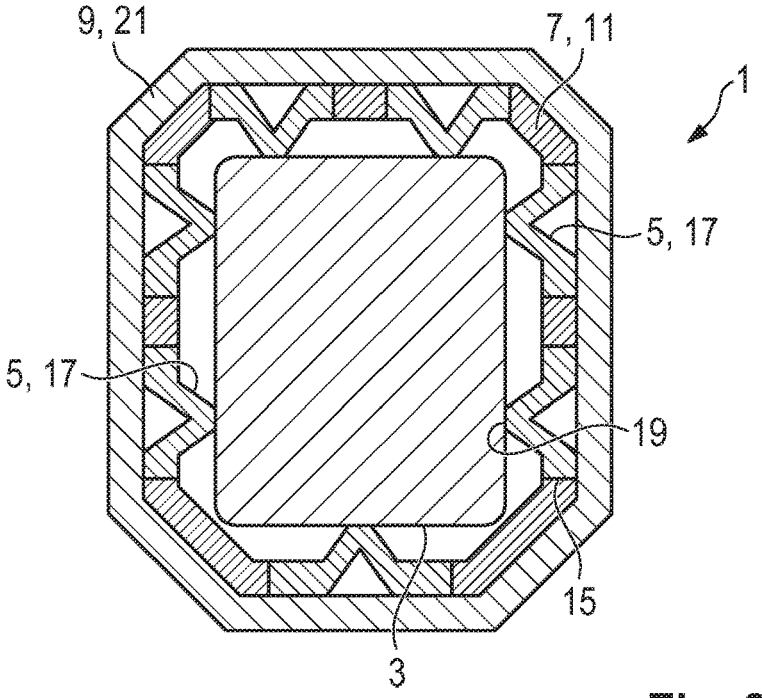
FIG. 2 is a cross-sectional view of the damping device and the receiver, which is taken along the line II-II of FIG. 1, in the direction of the arrows.
Figure 3:
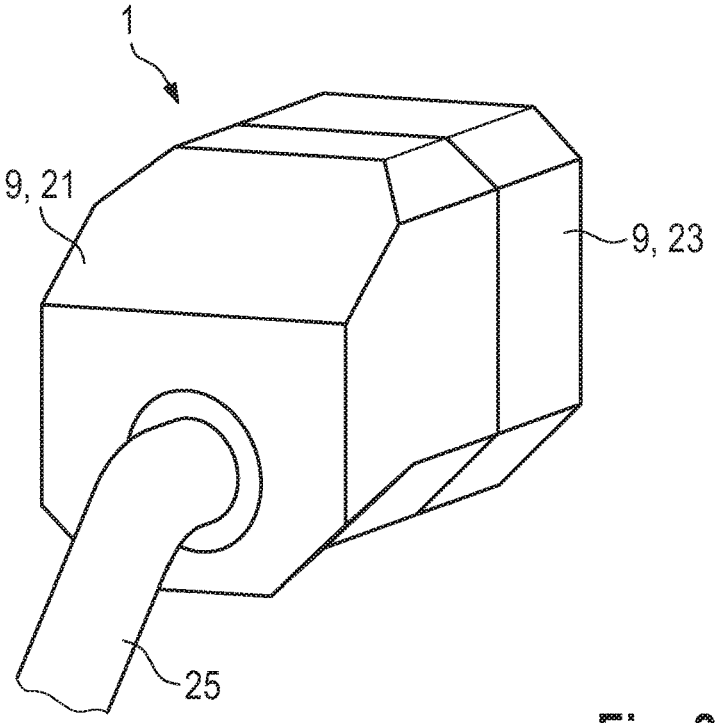
FIG. 3 is a fragmentary, perspective view of the damping device and the receiver in accordance with FIG. 1.
Figure 8:
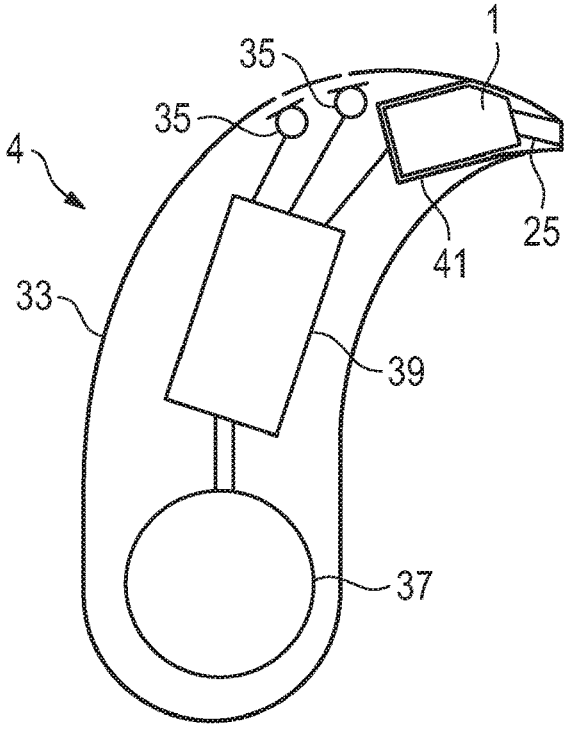
FIG. 8 is a longitudinal-sectional view of a hearing instrument with the damping device in accordance with one of the damping devices shown in FIGS. 1 to 7 and with the receiver mounted therein.

Referring now in detail to the figures of the drawings, in which corresponding parts are provided with identical reference numerals, and first, particularly, to FIGS. 1-3 thereof, there is seen a first exemplary embodiment of a damping device 1, which is used for the vibration-damped mounting of a receiver 3 within a hearing instrument implemented as a hearing aid 4 (see FIG. 8). The internal structure of the receiver 3 is not explicitly shown in the sectional views of FIGS. 1 and 2 for simplification purposes.

Figure 4:
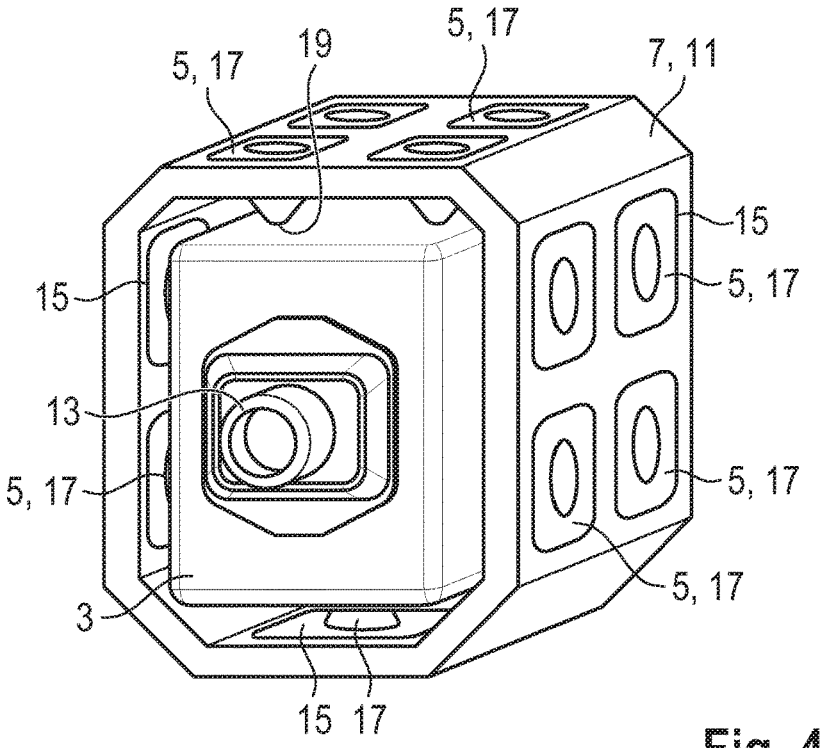
FIG. 4 is a perspective, isolated view of the elastic damping element and the cage of the damping device in accordance with FIG. 1 as well as the receiver mounted therein.

The damping device 1 includes an elastic damping element 5, a cage 7 supporting the damping element, and a shell 9 supporting the cage 7. In FIG. 4 the damping element 5 and the cage 7 with the receiver 3 mounted therein are isolated (i.e. without the surrounding shell 9).

The cage 7 in the embodiment shown in FIGS. 1 to 4 is formed by a tubular or pipe-shaped main body 11 made from a dimensionally stable plastic, namely preferably a thermosetting plastic. The tubular/pipe-shaped main body 11 has a roughly rectangular cross section, matched to the receiver 3, and encloses the side faces of the receiver 3 over their full extent. A sound outlet 13 of the receiver 3, and a rear side of the receiver 3 opposite the sound outlet 13, on the other hand, are disposed on the open sides of the tubular main body 11.

The cage 7 is provided on all sides with breakthroughs 15 (i.e., openings which extend from the inner periphery or circumference of the main body 11 to its outer periphery or circumference).

In the embodiment shown in FIGS. 1 to 4 the damping element 5 is formed of a number of unconnected retaining tabs in the form of hollow conical studs 17, having distal ends (i.e. those facing away from the inner circumference of the main body 11) each of which form one contact surface 19 for the receiver 3. The conical studs 17 are formed of an elastic material (for example, a fluorosilicone), which is softer than the material of the cage 7 and, for example, has a Shore hardness (Shore A) of 20-25, in particular 23.

One of the studs 17 is introduced, in particular injected, into each breakthrough 15 of the cage 7. Preferably, the cage 7 and the damping element 5 are produced together in a two-component injection molding process.

The shell 9 is formed of two parts, namely a front half-shell 21 and a rear half-shell 23. These half-shells 21, 23 complement each other, forming an airtight sealed casing for the receiver 3. The air volume enclosed by the half-shells 21, 23 and forming a mounting space for the receiver 3—if the receiver 3 is provided with a rear opening (back-venting)—is used as an extension of the rear volume of the receiver 3.

The front half-shell 21 surrounds the properly mounted receiver 3 on the same side on which the sound outlet 13 of the receiver 3 is disposed. A sound tube 25 of the hearing instrument 4 is passed through this front half-shell 21 of the shell 9 and is connected inside the shell 9 to the sound outlet 13, in order to transport the sound emitted through the sound outlet 13 to the ear of a wearer. In the embodiment in accordance with FIGS. 1 to 4 the sound tube 25 is a part which is manufactured separately from the front half-shell 21 and which is pressed into an opening 26 of the front half-shell 21 (see FIG. 1).

In the embodiment according to FIGS. 1 to 4 the two half-shells 21 and 23 of the shell 9 are manufactured from elastic material (e.g. "Viton"). This material is preferably chosen in such a way that the shell 9 is harder than the studs 17 of the damping element 5, but softer than the cage 7. For example, the material of the two half-shells 21 and 23 has a Shore hardness of 55. Alternatively, the front half-shell 21 is manufactured from a harder material than the rear half-shell 23, in particular from a dimensionally stable plastic or a metallic material.

Figure 5:
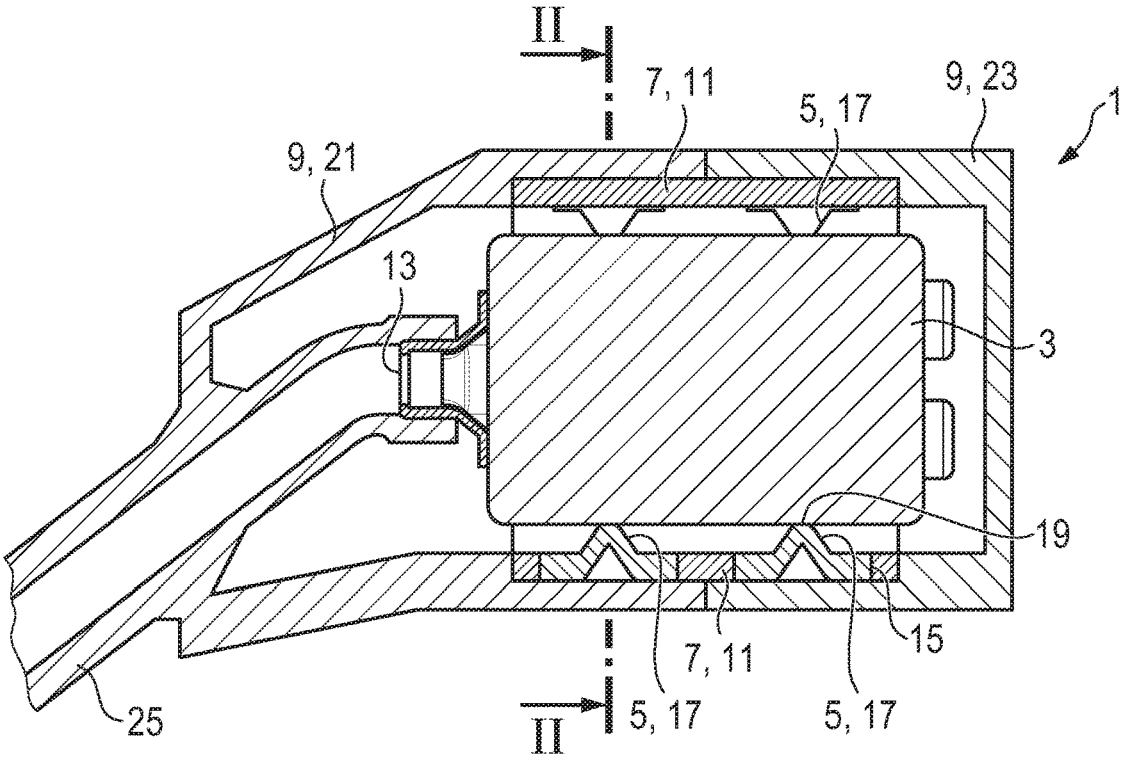
FIG. 5 is a view similar to FIG. 1 of an alternative exemplary embodiment of the damping device with the receiver mounted therein.

FIG. 5 shows an alternative exemplary embodiment of the damping device 1. This embodiment differs from the exemplary embodiment described above by the fact that the front half-shell 21 of the shell 9 is implemented in one piece (monolithically) with the sound tube 25.

Figure 6:
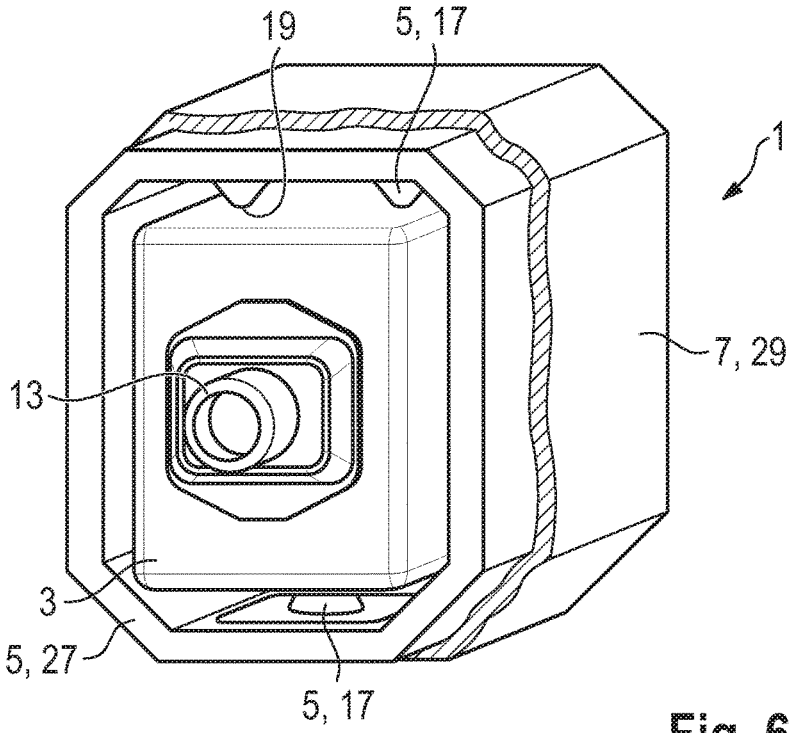
FIG. 6 is a view similar to FIG. 4 of the elastic damping element and the cage of a further exemplary embodiment of the damping device (with the cage only being partially shown therein) as well as the receiver mounted therein.
Figure 7:
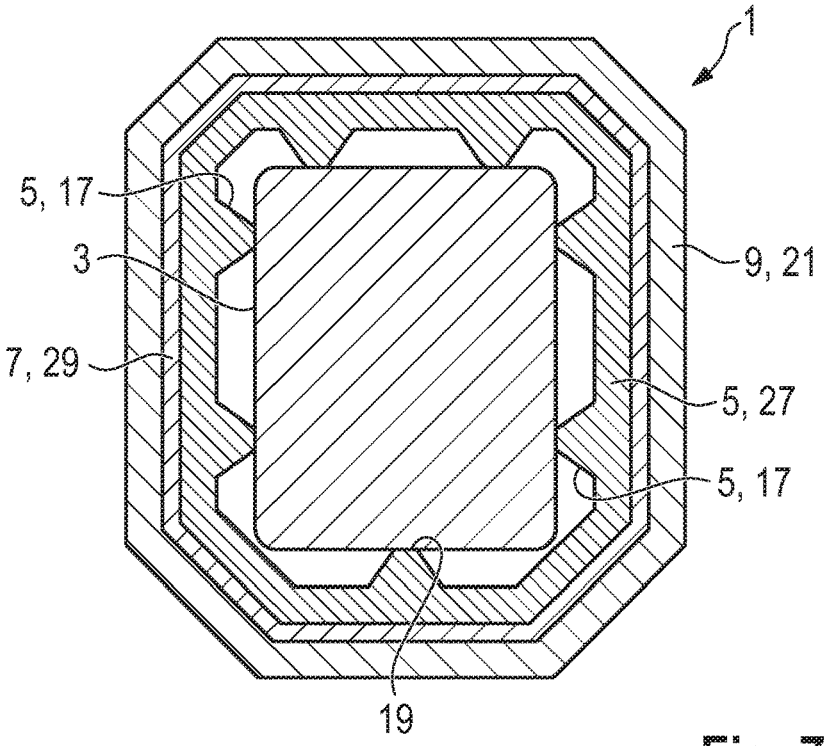
FIG. 7 is a view similar to FIG. 2 of the damping device in accordance with FIG. 6.

FIGS. 6 and 7 show another exemplary embodiment of the damping device 1. This exemplary embodiment differs from the exemplary embodiments described above by the fact that the damping element 5 itself forms a contiguous tube-shaped body 27, from the inner periphery or circumference of which the studs 17 protrude. In addition, the studs 17 in this case are not hollow but filled, so that the damping element 5 has a smooth outer circumference. The cage 7 in this case is formed by an additional tubular or pipe-shaped body 29, which in contrast to the main body 11 of the exemplary embodiment according to FIGS. 1 to 4 is configured with continuous side walls (i.e. without the breakthroughs 15). The cage 7 surrounds the damping element 5 on its outer side, so that the outer periphery or circumference of the damping element 5 rests in contact with the inner periphery or circumference of the cage 7. The cage 7 extends over the entire length of the damping element 5 (only part of the cage 7 is shown in FIG. 6 for better visibility of the damping element 5). Both the damping element 5 and the cage 7 are open on the front side on which the sound outlet 13 of the receiver 3 is disposed, and on the opposite rear side.

The damping element 5 and the cage 7 in this case preferably are formed of the materials identified in connection with the exemplary embodiment according to FIGS. 1 to 4. Alternatively, the cage 7 in this case is made of a metallic material, in particular a steel plate. In a further variant of the damping device 1 the cage 7 is wholly or partly embedded in the material of the sealing element 5.

In accordance with FIG. 8 the hearing instrument 4 includes a housing 33 in which the receiver 3 is mounted using one of the embodiments of the damping device 1 described above. The hearing instrument 4 further includes two microphones 35, a battery 37 and a signal processing unit 39 (e.g. in the form of a digital signal processor or a microcontroller). In the installed condition the shell 9 of the damping device 1 is at least partially in contact with a wall 41 of the housing 33, so that the receiver 3 is mounted without play in the housing 33 through the use of the damping device 1.

The invention is particularly clearly described in the exemplary embodiments described above, but at the same time is not limited to these exemplary embodiments. On the contrary, further embodiments of the invention can be derived from the claims and the above description. In particular, the individual features of the exemplary embodiments described within the claims can also be combined with each other in different ways without departing from the invention.

The following is a summary list of reference numerals and the corresponding structure used in the above description of the invention.

LIST OF REFERENCE NUMERALS

1 damping device
3 receiver
4 hearing instrument
5 damping element
7 cage
9 shell
11 main body
13 sound outlet
15 breakthrough
17 stud
19 contact surface
21 (front) half-shell
23 (rear) half-shell
25 sound tube
26 opening
27 body
29 body
33 hearing instrument housing
35 microphone
37 battery
39 signal processing unit
41 wall

The invention claimed is:

1. A damping assembly for a hearing instrument, the damping assembly comprising:
- a receiver;
- a damping device for anti-vibration mounting of said receiver within said damping device, said damping device including:
  - an elastic damping element;
  - a cage connected to said elastic damping element; and
  - a shell surrounding said cage;
- said elastic damping element and at least a part of said shell having a lower hardness than said cage.

2. The damping assembly according to claim 1, wherein said damping element is formed of an elastomer material with a Shore hardness in a range between 20 and 30.

3. The damping assembly according to claim 1, wherein said shell is at least partially formed of an elastomer material with a Shore hardness in a range between 50 and 60.

4. The damping assembly according to claim 1, wherein said cage is formed of a dimensionally stable plastic or a metallic material.

5. The damping assembly according to claim 1, wherein said elastic damping element is disposed on an inner periphery of said cage.

6. The damping assembly according to claim 1, wherein said shell is formed as a casing enclosing said damping element in an airtight manner.

7. A hearing instrument, comprising:
- a housing;
- and
- a damping assembly according to claim 1 mounting said receiver within said housing in an anti-vibration manner.

8. The hearing instrument according to claim 7, wherein said housing has a wall, and said shell of said damping device is at least partly in contact with said wall.

9. The damping assembly according to claim 1, wherein said receiver has an outer surface disposed within said damping device.

10. The damping assembly according to claim 1, wherein said receiver has a housing disposed within said damping device.

* * * * *